United States Patent [19]

Steinmair

[11] 4,441,661

[45] Apr. 10, 1984

[54] APPARATUS FOR STORING STRIP, PARTICULARLY METAL STRIP

[75] Inventor: Karl Steinmair, Schildberg, Austria

[73] Assignee: Voest-Alpine Aktiengesellschaft, Linz, Austria

[21] Appl. No.: 397,585

[22] Filed: Jul. 12, 1982

[30] Foreign Application Priority Data

Sep. 30, 1981 [AT] Austria ..... 4181/81

[51] Int. Cl.[3] ..... B65H 17/48

[52] U.S. Cl. ..... 242/55; 242/55.19 R

[58] Field of Search ..... 242/55, 55.17, 55.18, 242/55.19 R

[56] References Cited

U.S. PATENT DOCUMENTS

| | | | |
|---|---|---|---|
| 3,310,255 | 3/1967 | Sendzimir | 242/78.1 |
| 3,506,210 | 4/1970 | LaTour et al. | 242/55 |
| 4,288,042 | 9/1981 | Sendzimir | 242/55 |

FOREIGN PATENT DOCUMENTS

| | | |
|---|---|---|
| 1924542 | 11/1970 | Fed. Rep. of Germany . |
| 1507435 | 11/1967 | France . |

*Primary Examiner*—John Petrakes

*Attorney, Agent, or Firm*—Kurt Kelman

[57] ABSTRACT

Apparatus for storing metal strip comprises two coaxial roller cages, which are mounted in a common frame and include rotatably mounted rollers, which extend parallel to the horizontal axis of the cages. In order to minimize the outside diameter of the apparatus and to ensure a positive guidance of the metal strip, the roller cages are axially juxtaposed and the frame carries a strip guide, which extends inside the roller cages along an S-shaped path from the periphery of one cage to the periphery of the other cage. For a control of the apparatus, the frame is mounted for rotation on the axis of the cages.

5 Claims, 4 Drawing Figures

APPARATUS FOR STORING STRIP, PARTICULARLY METAL STRIP

Figure 1:
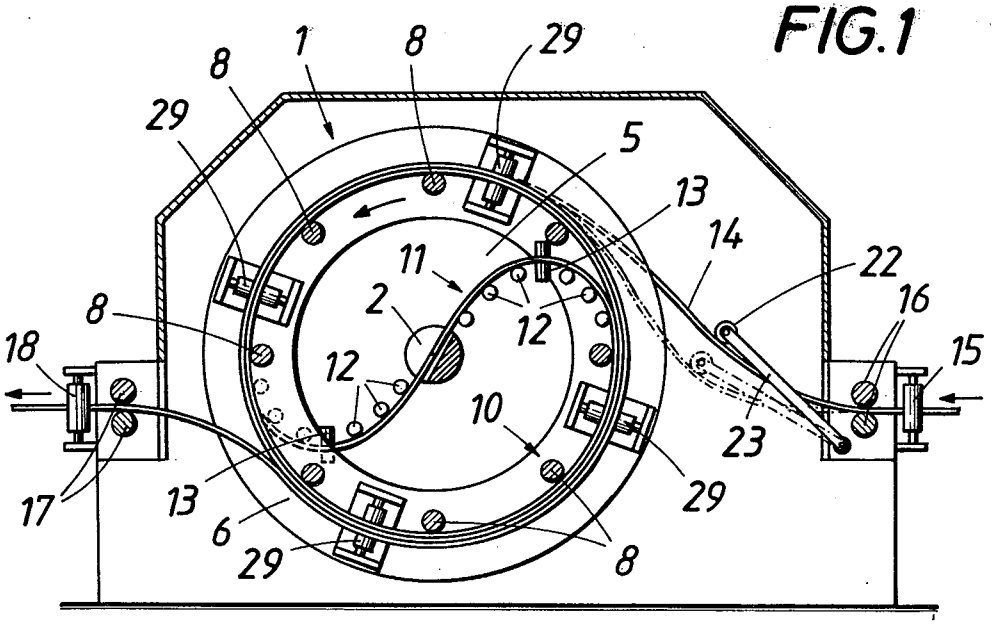

This invention relates to apparatus for storing strip, particularly metal strip, comprising two coaxial cages, which are mounted in a common frame and have rotatably mounted rollers, which extend parallel to the horizontal axis of the cages.

French Patent Specification No. 1,507,435 discloses apparatus for storing strip in which the convolutions of the stored strip are carried by two coaxial discs, which are mounted for rotation on a vertical axis and carry supporting rollers, which extend radially with respect to the axis of rotation of the discs and support the convolutions of the coiled strip stored on said supporting rollers. The stored strip extends along an S-shaped path from the inside of the coil formed on one disc to the inside of the coil formed on the other disc so that the strip can be delivered to the outside of one coil and withdrawn from the outside of the other coil. As the distribution of the convolutions of the stored strip to the two coils depends on the relative rotation of the elements of the apparatus, the discs must be driven by separate means, which must be controlled in dependence on each other so that an expensive control system is required. Because the rotary discs for carrying the convolutions of the stored strip are rotated on a vertical axis, the horizontal rotary discs occupy a large space. Besides, the strip must be rotated about its longitudinal axis through 90° before and behind the storing apparatus when it is delivered in a horizontal plane to the apparatus and coiled on the latter about a vertical axis of rotation and the strip is then withdrawn from that apparatus and subsequently conveyed in a horizontal plane. Besides, the metal strip is supported on edge in the apparatus so that the edges of the strip may be damaged, particularly when light-gage strip is stored.

In an attempt to avoid these disadvantages it has already been proposed in Laid-open German Application No. 19 24 542 to replace the rotary discs by concentric roller cages, which are rotatable on a horizontal axis. In this way the space requirement in a horizontal plane has been such decreased but this advantage is accompanied by the disadvantage that the apparatus for storing strip must be much larger in outside diameter because an annular clearance for accommodating the reversing loop between the inner and outer strip coils must be left between the two concentric roller cages which carry the convolutions of the stored strip. The strip is wound from the outside onto the outer roller cage and extends in the form of a free reversing loop from the inside of the outer strip coil to the outside of the inner strip coil and can be withdrawn from the inside of the latter. Owing to the free reversing loop, that arrangement of the strip between the roller cages ensures that equal numbers of convolutions will always be stored on the two roller cages but the strip cannot be guided in the reversing loop. Besides, the outer strip coil can be supported by the associated roller cage only on the outside so that the inner convolutions of the outer coil may sag at the upper apex. Another disadvantage resides in that the strip entering the apparatus cannot be pulled but must be pushed and may thus be kinked. Finally, the feeding of the strip to the outside of the inner and outer coils requires the diameter of each roller cage to be increased during operation if a slipping of adjacent convolutions on each other is to be avoided.

It is an object of the invention to avoid these disadvantages and so to improve apparatus of the kind described first hereinbefore for storing strip that the required outside diameter of the apparatus can be minimized, a positive guidance of the strip is ensured also in the loop which connects the two strip coils, and a simple control system can be used.

This object is accomplished according to the invention in that the roller cages are axially juxtaposed, the frame carries a strip guide, which is disposed within the space surrounded by the rollers of the roller cages and extends along an S-shaped path inside said roller cages periphery of one roller cage to the periphery of the other roller cage, and the frame is mounted for rotation on the axis of the roller cages.

Because the two roller cages are axially juxtaposed, the connecting loop formed by the strip between the two roller cages need not extend outside the rollers of one roller cage but may extend inside both roller cages so that it will not add to the outside diameter of the apparatus. Besides, with this arrangement of the roller cages, the strip may extend along an S-shaped path to the inside of the coil from which the strip is withdrawn for its further processing. This fact and the fact that the two roller cages and also the guide for guiding the connecting loop of the strip between the two roller cages are mounted in a common frame result in a fixed spatial coordination of these parts so that the convolutions of the coiled strip are supported on the inside by the cage rollers of both cages and there is no possibility for a sagging of convolutions in either roller cage. Besides, the strip is positively guided throughout its passage through the storing apparatus.

Because the roller cages are firmly coordinated with each other and with the strip guide disposed between the roller cages, the frame which carries these structural elements must be rotatably mounted so that differences between the velocity of the incoming and outgoing strips can be taken up. Strip can be stored and can be withdrawn from the storage apparatus by a rotation of the frame in one sense and another.

A particularly clear arrangement will be obtained if the roller cages are equal in diameter because in that case the same quantity of strip will be delivered to or taken from each roller cage by each revolution of the frame. In that case the means for driving the frame and the control means for said drive may be very simple. It will be sufficient to drive the roller cage by the frame-driving means at a peripheral velocity which equals one-half of the difference between the velocities of the strip before and behind the storage apparatus so that the frame-driving means do not subject the incoming and outgoing strip to additional stress.

As the strip is delivered from the inside of one strip coil along an S-shaped path to the inside of the other strip coil, the inside diameter of one coil will increase and the inside diameter of the other coil will decrease by the same extent. That fact may be used for an automatic compensation of the diameters of the roller cages in that the frame carries swiveling shafts, which have parallel axes and extend through the two juxtaposed roller, each of the swiveling shafts carries two pairs of radial arens, one roller of each of said roller cages is carried by one of said pairs of radial arens, and the two rollers mounted on the same swiveling shaft are disposed on opposite sides of an axial plane which extends through the axis of the cages and the axis of the swiveling shaft. In such an arrangement an inward pivotal movement of one of the two rollers mounted on a swiveling shaft so as to decrease the diameter of the associated roller cage will cause the associated swiveling shaft to impart an outward pivotal movement to the associated roller of the other roller cage. This will result in the desired adaptation of the roller cages to the coil diameters changing in opposite senses. As additional convolutions of strip are formed on the inside of one of the strip coils, the inside diameter of said strip coil is reduced so that the described result is obtained without a need for a control system for this purpose. It will be sufficient to ensure that when the storage apparatus has been filled and subsequently emptied the rollers of the roller cages are moved to an initial position, in which the cages are preferably equal to diameter, for this purpose the shafts for swiveling the rollers of the roller cages may be rotatable to the initial position by a resetting drive.

Figure 2:
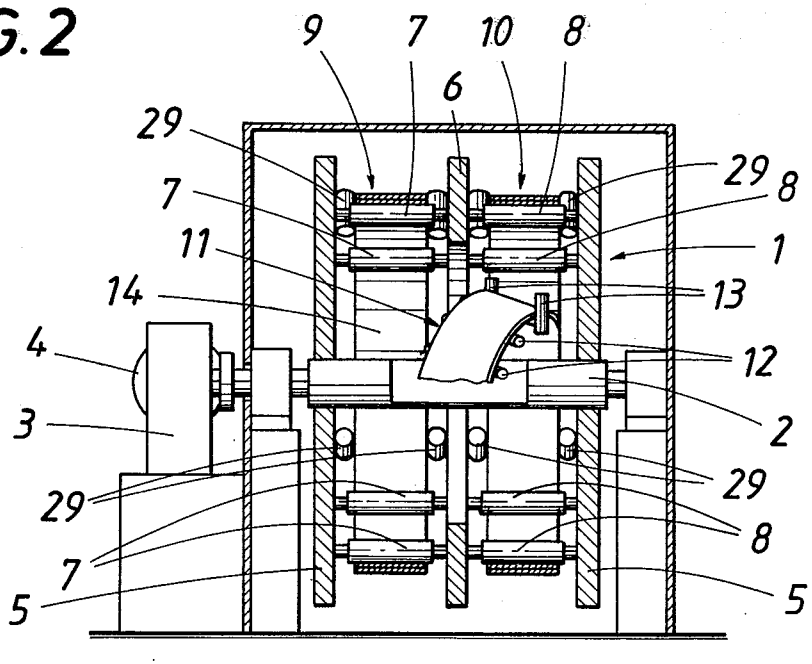
Figure 3:
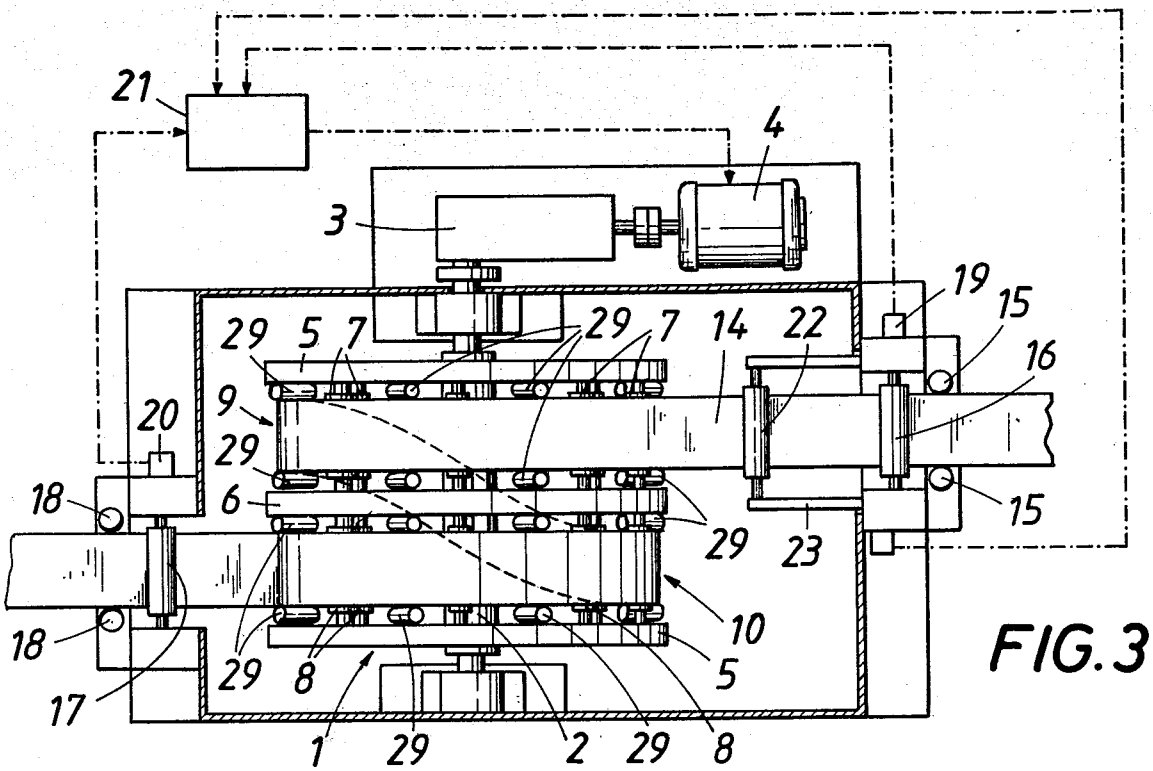
Figure 4:
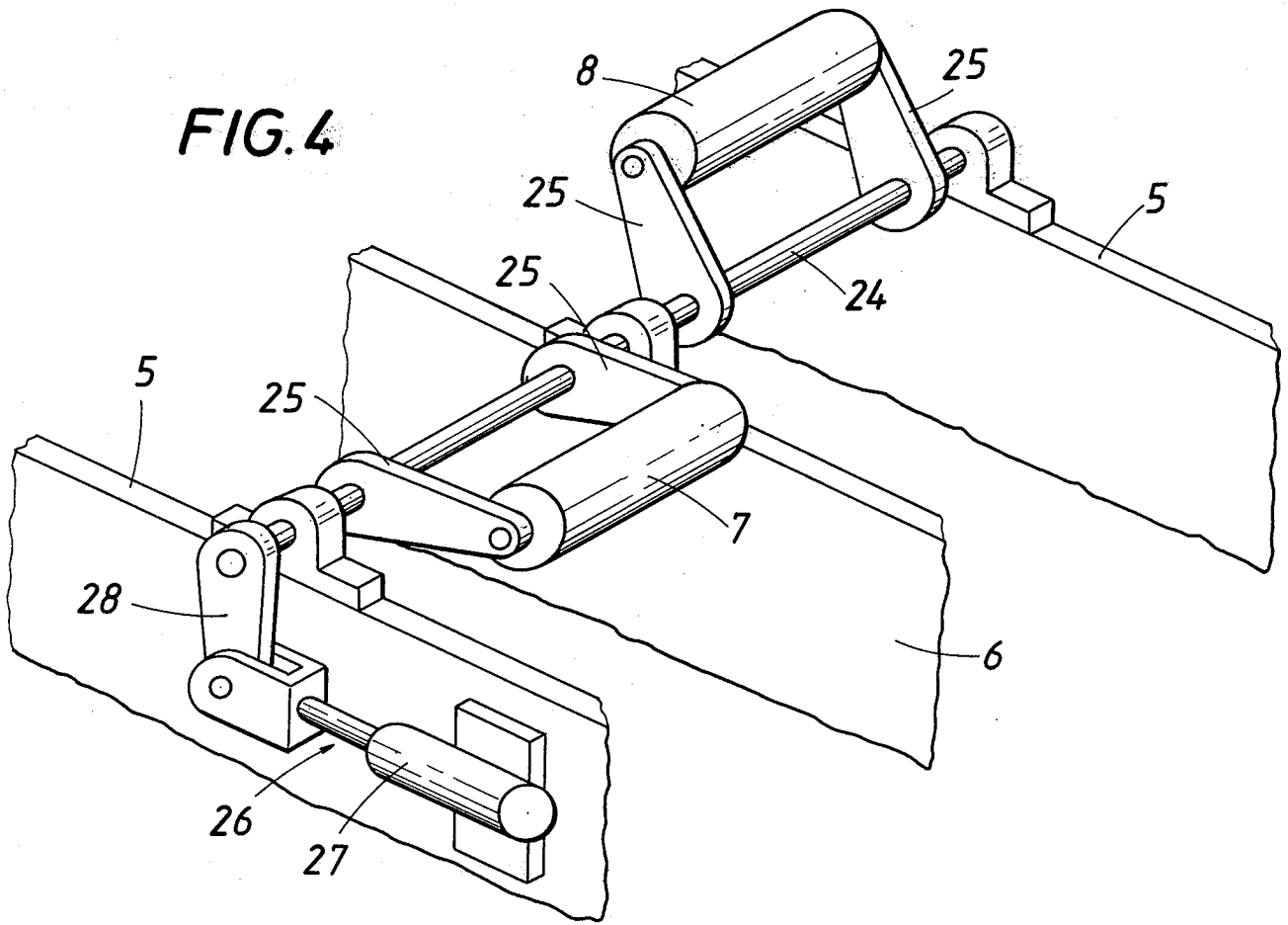

An illustrative embodiment of the invention is shown by way of example on the drawings, in which FIG. 1 is a simplified sectional view, taken on a line that is transverse to the axis of the roller cages and shows a strip storage apparatus according to the invention, FIG. 2 is an axial sectional view showing the apparatus, FIG. 3 is a top plan view showing the apparatus and FIG. 4 is an axonometric perspective view showing the adjustable mounting of the rollers of the two roller cages.

The strip storage apparatus shown in FIGS. 1 to 3 comprises a frame 1, which is mounted on a horizontal shaft 2 and is adapted to be driven by a motor 4 through the intermediary of a transmission 3. The frame 1 comprises two end walls 5 and an annular disc 6, which is disposed between the end walls 5. A roller cage 9 comprising a circular series of rollers 7 is disposed between the annular disc 6 and one of the end walls 5. A roller cage 10 comprising a circular series of rollers 8 is disposed between the annular disc 6 and the other end wall 5. These roller cages 9 and 10 are axially juxtaposed and can be rotated by the frame 1.

The space inside the roller cages 9 and 10 and the annular disc 6 contains a strip guide 11, which comprises a roller conveyor 12, which extends along an S-shaped path from the periphery of the cage 9 to the periphery of the cage 10, as is particularly apparent from FIGS. 1 and 3. The strip guide 11 also comprises guide rollers 13 on opposite sides of the roller conveyor 12. The roller conveyor 12 and the guide rollers 13 are mounted in the frame 1 in a manner which is not shown for the sake of clearness. Because the roller cages 9 and 10 and the strip guide 11 for guiding the strip between said roller cages are held in the frame 1, there is a permanent spatial coordination between these parts of the structure and the strip will be positively guided throughout its passage through the apparatus.

The strip 14 which is to be stored is delivered to the roller cage 9 from the outside via vertical guide rollers 15 and horizontal guide rollers 16 and is then moved on the roller conveyor 12 of the strip guide 11 to the roller cage 10 to contact the latter on the outside and is then moved to a pair of rollers 17, which are succeeded by lateral guide rollers 18. When the frame 1 is then driven in the sense indicated by the arrow in FIG. 1, the strip will be wound on each of the roller cages 9 and 10 to form convolutions equal in number to the revolutions of the frame. The storage apparatus will be emptied by a rotation of the frame 1 in the opposite sense. Because the roller cages 9 and 10 are equal in diameter, equal quantities of strip are removed from the coils mound on each roller cage. For this reason the peripheral velocity of the roller cages 9 and 10 must be controlled to be equal to one-half of the difference between the velocities at which the strip enters and leaves the storage apparatus and the motor 4 for driving the frame 1 must be controlled accordingly. For this purpose, velocity sensors 19 and 20 are respectively connected to the pair of guide rollers 16 for guiding the incoming strip and to the pair of guide rollers 17 for guiding the outgoing strip and generate signals representing the velocities of the incoming and outgoing strip 14, respectively. These signals are delivered to a controller 21, which controls the motor 4 in dependence on the differential velocity which has been sensed. The controller 21 is also responsive to a signal which represents the tension of the incoming strip and is generated by a tension sensor associated with a roller 22, which is mounted on a pair of pivoted arms 23 and engages the incoming strip. In this manner the tension of the strip is also taken into account.

As the strip is supplied from the inside to the strip coil on the delivering roller cage 10, the inside diameter of said coil decreases an additional strip is supplied and the rollers 8 of that roller cage must be moved radially inwardly if sliding friction between adjacent convolutions of this coil is to be avoided. At the same time, the inside diameter of the coil on the receiving roller cage 9 increases as the strip in withdrawn over the strip guide 11 from the inside of that coil. To allow for these changes in diameter, swiveling shafts 24 are rotatably mounted in the end walls 5 of the frame 1 and extend through both roller cages 9 and 10 and each of said swiveling shafts carries two pairs of radial arms 25. A roller 7 of the roller cage 9 and a roller 8 of the roller cage 10 are rotatably mounted at the free ends of the respective pairs of arms 25 carried by each of the swiveling shafts 24 in such a manner that the rollers 7 and 8 carried by the same swiveling shaft 24 are disposed on opposite sides of an axial plane which extends through the axis of the shaft 24 and the axis of the cages. As a result, a rotation of the shaft 24 will move the roller 7 and 8 in mutually opposite radial directions. If a storing of strip is initiated when the apparatus is in the initial position shown in FIG. 4, the removal of convolutions from the roller cage 9 will increase the inside diameter of the coil on said cage and the addition of convolutions to the roller cage 10 will decrease the inside diameter of the coil on the cage 10. In accordance therewith, the rollers 8 of the roller cage 10 will be turned inwardly so that the swiveling shafts 24 will turn the rollers 7 of the roller cage 9 outwardly. This will ensure the desired adaptation to the changing diameters without a need for additional control means. This automatic adjustment has also a self-centering effect. A resetting drive 26 is provided for turning the rollers 7 and 8 back to their initial position, in which the roller cages 9 and 10 are equal in diameter, and in the present embodiment comprises a cylinder 27, which is connected to a crank arm 28 connected to the swiveling shaft 24.

To provide for a lateral guidance of the coils formed on the roller cages 9 and 10, radially extending guide rollers 29 may be disposed on opposite sides of each of the roller cages 9 and 10 and may be adjustably mounted for adaptation to strips differing in width. Where such lateral guide rollers 29 are provided, the shaft 2 carrying the frame 1 may be inclined from the horizontal if this is desired in special cases.

What is claimed is:

1. In apparatus for storing strip, comprising a frame and two roller cages having a common horizontal axis and mounted on said frame and rotatable about said common axis, each of said roller cages comprising a circular series of angularly spaced apart, rotatably and radially adjustably mounted rollers parallel to said common axis, the improvement residing in that said frame is mounted for rotating about said common axis, said roller cages are axially juxtaposed and non-rotatably connected to said frame, the rollers of said roller cages are equal in number and angular spacing, a circular series of swiveling shafts equal in number and angular spacing to the rollers of each of said axes and parallel to those of said rollers are rotatably mounted in said frame and extend through both said roller cages, each of said swiveling shafts carries two pairs of radial arms, each of said rollers of said roller cages is carried by one of said pairs of radial arms and eccentric with respect to the associated swiveling shaft, said two pairs of arms mounted on each of said swiveling shafts are so arranged that the rollers carried by said swiveling shafts are disposed on opposite sides of an axial plane which extends through said common axis and the axis of said swiveling shaft, and a strip guide is carried by and non-rotatably connected to said frame and extends inside said roller cages along an S-shaped path from a point near the periphery of one of said roller cages to a point near the periphery of the other of said roller cages.

2. The improvement set forth in claim 1, wherein drive means for rotating said frame about said common axis are provided.

3. The improvement set forth in claim 1, wherein said roller cages are substantially equal in diameter.

4. The improvement set forth in claim 3, further comprising feeding means adapted to feed strip to the outside periphery of one of said roller cages, withdrawing means are provided, which are adapted to withdraw strip from the outside periphery of the other of said roller cages, drive means for rotating said frame about said common axis are provided, and control means for controlling the speed of said drive means and comprising a first velocity sensor for sensing the velocity of strip fed by said feeding means, a second velocity sensor for sensing the velocity of strip withdrawn by said withdrawing means, and a controller, which is operatively connected to said first and second velocity sensors and to said drive means and adapted to control the latter to rotate said frame at such a speed that the peripheral velocity of said roller cages equals one-half of the difference between the velocity of said strip fed by said feeding means and the velocity of said strip withdrawn by said withdrawing means.

5. The improvement set forth in claim 1, wherein resetting means are operatively connected to said swiveling shafts and operable to rotate said swiveling shafts so as to move said rollers of both said roller cages to positions in which said roller cages are equal in diameter.

* * * * *